US005758515A

United States Patent [19]

Howard

[11] Patent Number: 5,758,515

[45] Date of Patent: Jun. 2, 1998

[54] CRYOGENIC AIR SEPARATION WITH WARM TURBINE RECYCLE

[75] Inventor: Henry Edward Howard, Grand Island, N.Y.

[73] Assignee: Praxair Technology, Inc., Danbury, Conn.

[21] Appl. No.: 848,410

[22] Filed: May 8, 1997

[51] Int. Cl.[6] ..... F25J 1/00

[52] U.S. Cl. ..... 62/646; 62/654

[58] Field of Search ..... 62/646, 654

[56] References Cited

U.S. PATENT DOCUMENTS

| | | | |
|---|---|---|---|
| 4,152,130 | 5/1979 | Theobald | 62/18 |
| 4,555,256 | 11/1985 | Skolaude et al. | 62/18 |
| 5,108,476 | 4/1992 | Dray et al. | 62/24 |
| 5,114,452 | 5/1992 | Dray | 62/24 |
| 5,123,249 | 6/1992 | Buttle | 62/24 |
| 5,157,926 | 10/1992 | Guilleminot | 62/24 |
| 5,287,704 | 2/1994 | Rathbone | 62/25 |
| 5,329,776 | 7/1994 | Grenier | 62/24 |
| 5,400,600 | 3/1995 | Grenier | 62/25 |
| 5,454,226 | 10/1995 | Darredeau et al. | 62/9 |
| 5,477,689 | 12/1995 | Guillard et al. | 62/25 |
| 5,651,270 | 7/1997 | Low et al. | 62/613 |

*Primary Examiner*—Ronald C. Capossela
*Attorney, Agent, or Firm*—Stanley Ktorides

[57] ABSTRACT

A cryogenic air separation system wherein feed air is compressed in a multistage primary air compressor, a first part is turboexpanded and fed into a cryogenic air separation plant, and a second part is turboexpanded and at least a portion of the turboexpanded second part is recycled to the primary air compressor at an interstage position.

10 Claims, 2 Drawing Sheets

CRYOGENIC AIR SEPARATION WITH WARM TURBINE RECYCLE

TECHNICAL FIELD

This invention relates generally to cryogenic air separation and, more particularly, to cryogenic air separation systems wherein liquid from the cryogenic air separation plant is vaporized prior to recovery.

BACKGROUND ART

Oxygen is produced commercially in large quantities by the cryogenic rectification of feed air in a cryogenic air separation plant. At times it may be desirable to produce oxygen at a higher pressure. While gaseous oxygen may be withdrawn from the cryogenic air separation plant and compressed to the desired pressure, it is generally preferable for capital cost purposes to withdraw oxygen as liquid from the cryogenic air separation plant, increase its pressure, and then vaporize the pressurized liquid oxygen to produce the desired elevated pressure product oxygen gas.

The withdrawal of the oxygen as liquid from the cryogenic air separation plant removes a significant amount of refrigeration from the plant necessitating significant reintroduction of refrigeration into the plant. This is even more the case when, in addition to the high pressure oxygen gas, it is desired to recover liquid product, e.g. liquid oxygen and/or liquid nitrogen, from the plant.

One very effective way to provide refrigeration into a cryogenic air separation plant is to turboexpand a compressed gas stream and to pass that stream, or at least the refrigeration generated thereby, into the plant. In situations where significant amounts of liquid are withdrawn from the plant, more than one such turboexpander is often employed. However, the use of multiple turboexpanders is complicated because small differences in turbine flows and pressures with respect to the cryogenic air separation plant and to the primary air compressor will cause a sharp decrease in system efficiency rendering the system uneconomical.

Accordingly, it is an object of this invention to provide an improved system for the cryogenic rectification of feed air employing more than one turboexpander.

SUMMARY OF THE INVENTION

The above and other objects, which will become apparent to one skilled in the art upon a reading of this disclosure, are attained by the present invention, one aspect of which is:

A method for carrying out cryogenic air separation comprising:

(A) compressing feed air in a primary air compressor having a plurality of first through $n^{th}$ compression stages to produce compressed feed air;

(B) cooling a first part of the compressed feed air, turboexpanding the cooled first part, and passing the turboexpanded first part into a cryogenic air separation plant;

(C) further compressing a second part of the compressed feed air, cooling the further compressed second part, turboexpanding at least a portion of the cooled second part, and recycling at least some of the turboexpanded second part to the feed air between the first and the $n^{th}$ compression stage;

(D) producing liquid oxygen within the cryogenic air separation plant, withdrawing liquid oxygen from the cryogenic air separation plant, and vaporizing the withdrawn liquid oxygen by indirect heat exchange with both the cooling first part of the feed air and the cooling second part of the feed air to produce gaseous oxygen; and (E) recovering gaseous oxygen as product.

Another aspect of the invention is:

Apparatus for carrying out cryogenic air separation comprising:

(A) a primary air compressor having a plurality of first through $n^{th}$ compression stages, a main heat exchanger, a primary turboexpander, and a cryogenic air separation plant;

(B) means for passing feed air into the first stage of the primary air compressor and means for withdrawing feed air from the $n^{th}$ stage of the primary air compressor;

(C) means for passing feed air from the $n^{th}$ stage of the primary air compressor to the main heat exchanger, from the main heat exchanger to the primary turboexpander, and from the primary turboexpander to the cryogenic air separation plant;

(D) a booster compressor, a secondary turboexpander, means for passing feed air from the $n^{th}$ stage of the primary air compressor to the booster compressor, from the booster compressor to the main heat exchanger, from the main heat exchanger to the secondary turboexpander, and from the secondary turboexpander to the primary air compressor between the first and $n^{th}$ compression stage; and (E) means for passing liquid from the cryogenic air separation plant to the main heat exchanger and means for recovering vapor from the main heat exchanger.

As used herein, the term "liquid oxygen" means a liquid having an oxygen concentration greater than 50 mole percent.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process*. The term, double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluid streams into heat exchange relation without any physical contact or intermixing of the fluids with each other.

As used herein, the term "feed air" means a mixture comprising primarily oxygen and nitrogen, such as ambient air.

As used herein, the terms "upper portion" and "lower portion" of a column mean those sections of the column respectively above and below the mid point of the column.

As used herein, the terms "turboexpansion" and "turboexpander" mean respectively method and apparatus for the flow of high pressure gas through a turbine to reduce the pressure and the temperature of the gas, thereby generating refrigeration.

As used herein the term "compressor" means a machine that increases the pressure of a gas by the application of work.

As used herein, the term "cryogenic air separation plant" means a facility for fractionally distilling feed air, comprising one or more columns and the piping, valving and heat exchange equipment attendant thereto.

As used herein, the term "primary air compressor" means a compressor which provides the greater portion of the air compression necessary to operate a cryogenic air separation plant.

As used herein, the term "booster compressor" means a compressor which provides additional compression for purposes of attaining higher air pressures required for the vaporization of liquid oxygen and/or process turboexpansion(s) in conjunction with a cryogenic air separation plant.

As used herein, the term "compression stage" means a single element, e.g. compression wheel, of a compressor through which gas is increased in pressure. A compressor must be comprised of at least one compression stage.

The numerals in the Figures are the same for the common elements.

DETAILED DESCRIPTION

In the practice of this invention a portion of the feed air bypasses the primary turboexpander which turboexpands feed air into the cryogenic air separation plant, and, instead, is turboexpanded in a secondary turboexpander and recycled back to the primary air compressor at an interstage position. This reduces the power consumption required by the primary air compressor and thus increases the overall efficiency of the cryogenic air separation system.

Figure 1:
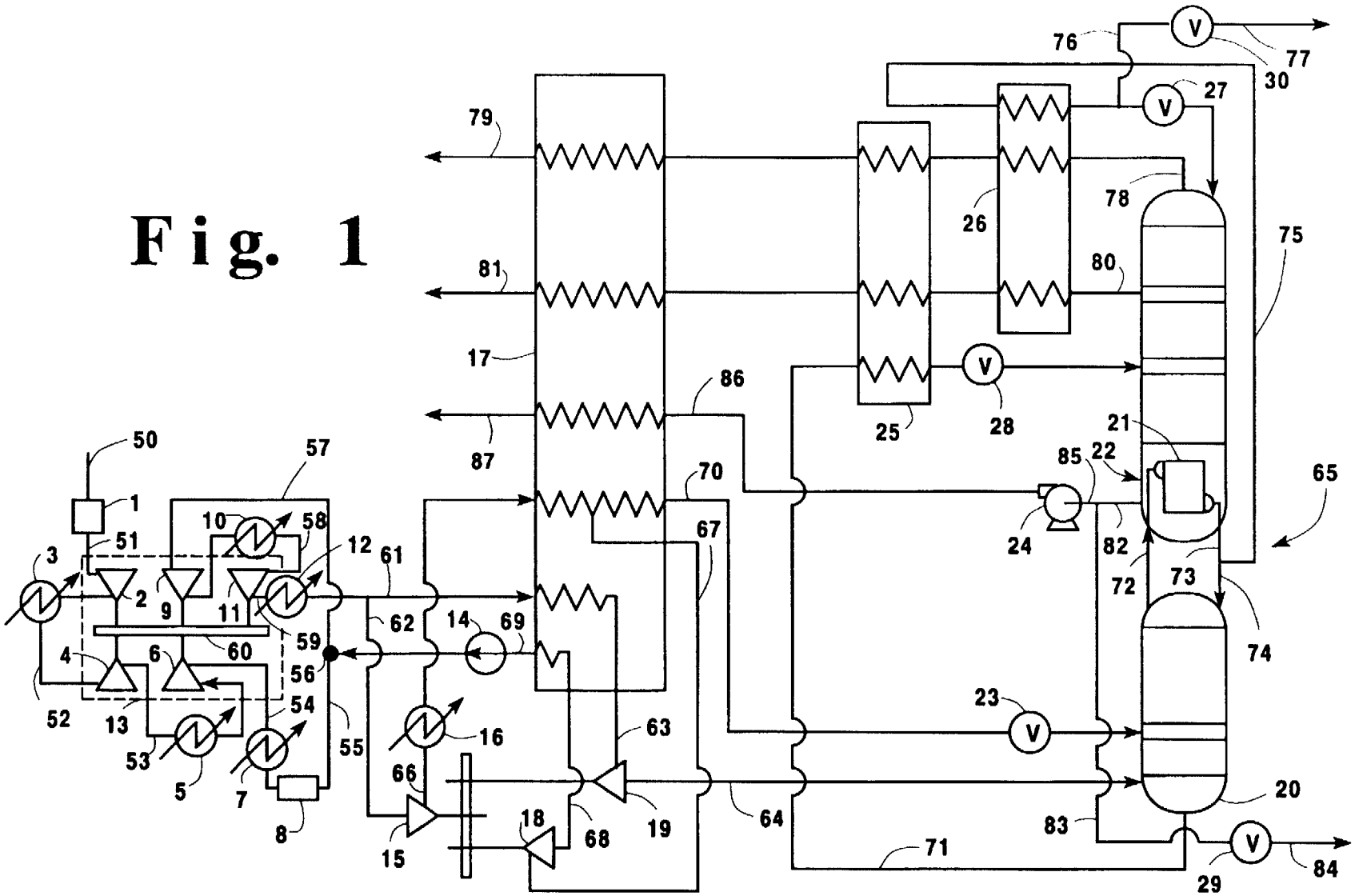
FIG. 1 is a schematic representation of one preferred embodiment of the invention.

The invention will be described in greater detail with reference to the Drawings. Referring now to FIG. 1, feed air 50 at about atmospheric pressure, is cleaned of particulates by passage through filter house 1. The resulting feed air 51 is then passed into primary air compressor 13 which, in the embodiment of the invention illustrated in FIG. 1, comprises five compression stages, the fifth or last stage being the $n^{th}$ stage. In the practice of this invention the primary air compressor will generally have at least 3 compression stages, and typically will have from 4 to 6 compression stages. Feed air 51 is passed into first compression stage 2 of primary air compressor 13 wherein it is compressed and resulting feed air 52 is cooled by passage through intercooler 3. Feed air 52 is then further compressed by passage through second compression stage 4 of primary air compressor 13 and resulting feed air 53 is cooled by passage through intercooler 5. Feed air 53 is then further compressed by passage through third compression stage 6 of primary air compressor 13 and resulting feed air 54 is cooled by passage through intercooler 7. Feed air 54 is then passed through prepurifier 8 wherein it is cleaned of high boiling impurities such as carbon dioxide, water vapor and hydrocarbons.

Cleaned feed air 55 is then passed into fourth compression stage 9 of primary air compressor 13. Preferably, as in the embodiment of the invention illustrated in FIG. 1, feed air stream 55 is combined with warm turbine recycle, such as at union point 56, and the resulting combined feed air stream 57 is passed into fourth compression stage 9 wherein it is compressed to a higher pressure. Resulting feed air stream 58 is cooled by passage through intercooler 10 and then passed into fifth compression stage 11 of primary air compressor 13 wherein it is compressed to a higher pressure and from which it is withdrawn as compressed feed air stream 59 having a pressure within the range of from 200 to 750 pounds per square inch absolute (psia). Primary air compressor 13 is powered by an external motor (not shown) with a rotor driving bull gear 60.

Compressed feed air 59 is cooled by passage through aftercooler 12 and divided into first part 61 and second part 62. First part 61 comprises from about 50 to 55 percent of compressed feed air 59. First part 61 is passed to main heat exchanger 17 wherein it is cooled by indirect heat exchange with return streams. After partial traverse of main heat exchanger 17, cooled first part 63 is passed to primary turboexpander 19 wherein it is turboexpanded to a pressure within the range of from 65 to 85 psia. Resulting turboexpanded first part 64 is passed into a cryogenic air separation plant. In the embodiment illustrated in FIG. 1 the cryogenic air separation plant 65 is a double column plant comprising first or higher pressure column 20 and second or lower pressure column 22, and turboexpanded first part 64 is passed into the lower portion of higher pressure column 20.

Second part 62 comprises from 45 to 50 percent of compressed feed air 59. Second part 62 is passed to booster compressor 15 wherein it is further compressed to a pressure within the range of from 500 to 1400 psia. Further compressed second part 66 is cooled by passage through cooler 16 and then passed into main heat exchanger 17 wherein it is cooled by indirect heat exchange with return streams. At least a portion of the cooled second part, shown in FIG. 1 as stream 67, is withdrawn after partial traverse of main heat exchanger 17 and passed to secondary turboexpander 18 wherein it is turboexpanded to a pressure within the range of from 75 to 150 psia. Resulting turboexpanded second part 68 is warmed by partial traverse of main heat exchanger 17 and then recycled to the primary air compressor between the first and last stages, i.e. at an interstage position. In the embodiment illustrated in FIG. 1 the warmed turbine recycle 69 is passed through pressure control device 14 before being recycled to the feed air 55 at union point 56 for recycle to the primary air compressor between the third and fourth compression stages of primary air compressor 13. Pressure control device 14 may be, for example, a valve, a compressor or a blower.

If desired, a portion of second part 66 may completely traverse main heat exchanger 17 wherein it is liquefied. This portion, shown as 70 in the embodiment illustrated in FIG. 1, is passed through valve 23 and into higher pressure column 20. Instead of passage through valve 23, portion 70 may be passed through a dense phase, that is supercritical fluid or liquid, turbo machine to recover the pressure energy. Typically the recovered shaft work will drive an electrical generator.

Higher pressure column 20 is operating at a pressure generally within the range of from 65 to 85 psia. Within higher pressure column 20, the feed air fed into column 20 is separated by cryogenic rectification into nitrogen-enriched vapor and oxygen-enriched liquid. Oxygen-enriched liquid is withdrawn from the lower portion of higher pressure column 20 as stream 71, subcooled by passage through subcooler 25, and passed through valve 28 and into lower pressure column 22. Nitrogen-enriched vapor is withdrawn from higher pressure column 20 as stream 72 and passed into main condenser 21 wherein it is condensed by indirect heat exchange with boiling lower pressure column 22 bottom liquid. Resulting nitrogen-enriched liquid 73 is withdrawn from main condenser 21, a first portion 74 is returned to higher pressure column 20 as reflux, and a second portion 75 is subcooled by passage through subcooler 26, and passed through valve 27, into lower pressure column 22. If desired, a portion of the nitrogen-enriched liquid may be recovered as product liquid nitrogen having a nitrogen concentration of at least 99.99 mole percent. In the embodiment of the invention illustrated in FIG. 1, a portion 76 of nitrogen-enriched liquid 75 is passed through valve 30 and recovered as liquid nitrogen product 77.

Lower pressure column 22 is operating at a pressure less than that of higher pressure column 20 and generally within the range of from 15 to 25 psia. Within lower pressure column 22 the various feeds are separated by cryogenic rectification into nitrogen-rich vapor and oxygen-rich liquid. Nitrogen-rich vapor is withdrawn from the upper portion of lower pressure column 22 as stream 78, warmed by passage through heat exchangers 26, 25 and 17 and removed from the system as stream 79 which may be recovered as product nitrogen gas having a nitrogen concentration of at least 99.99 mole percent. For product purity control purposes, a nitrogen containing stream 80 is withdrawn from lower pressure column 22 below the level from which stream 78 is withdrawn. Stream 80 is warmed by passage through heat exchangers 26, 25 and 17 and withdrawn from the system as stream 81.

Oxygen-rich liquid, i.e. liquid oxygen, is withdrawn from the lower portion of lower pressure column 22 as liquid oxygen stream 82. If desired a portion of the oxygen-rich liquid may be recovered as product liquid oxygen, such as in the embodiment illustrated in FIG. 1 wherein stream 83 is branched off of stream 82, passed through valve 29 and recovered as liquid oxygen stream 84.

The oxygen-rich liquid is increased in pressure prior to vaporization. In the embodiment illustrated in FIG. 1, the major portion 85 of stream 82 is passed to liquid pump 24 wherein it is pumped to a pressure within the range of from 150 to 1400 psia. Resulting pressurized liquid oxygen stream 86 is passed through main heat exchanger 17 wherein it is vaporized by indirect heat exchange with both cooling first feed air part 61 and cooling second feed air part 66. Resulting gaseous oxygen is withdrawn from main heat exchanger 17 as stream 87 and recovered as product gaseous oxygen having an oxygen concentration of at least 50 mole percent. The liquid oxygen is advantageously vaporized by passage through main heat exchanger 17 rather than in a separate product boiler as this enables a portion of the cooling duty of stream 61 to be imparted to stream 86 thereby reducing the requisite pressure of boosted feed air stream 66. Moreover, the need for a second heat exchanger apparatus for the vaporization of stream 86 is eliminated.

Figure 2:
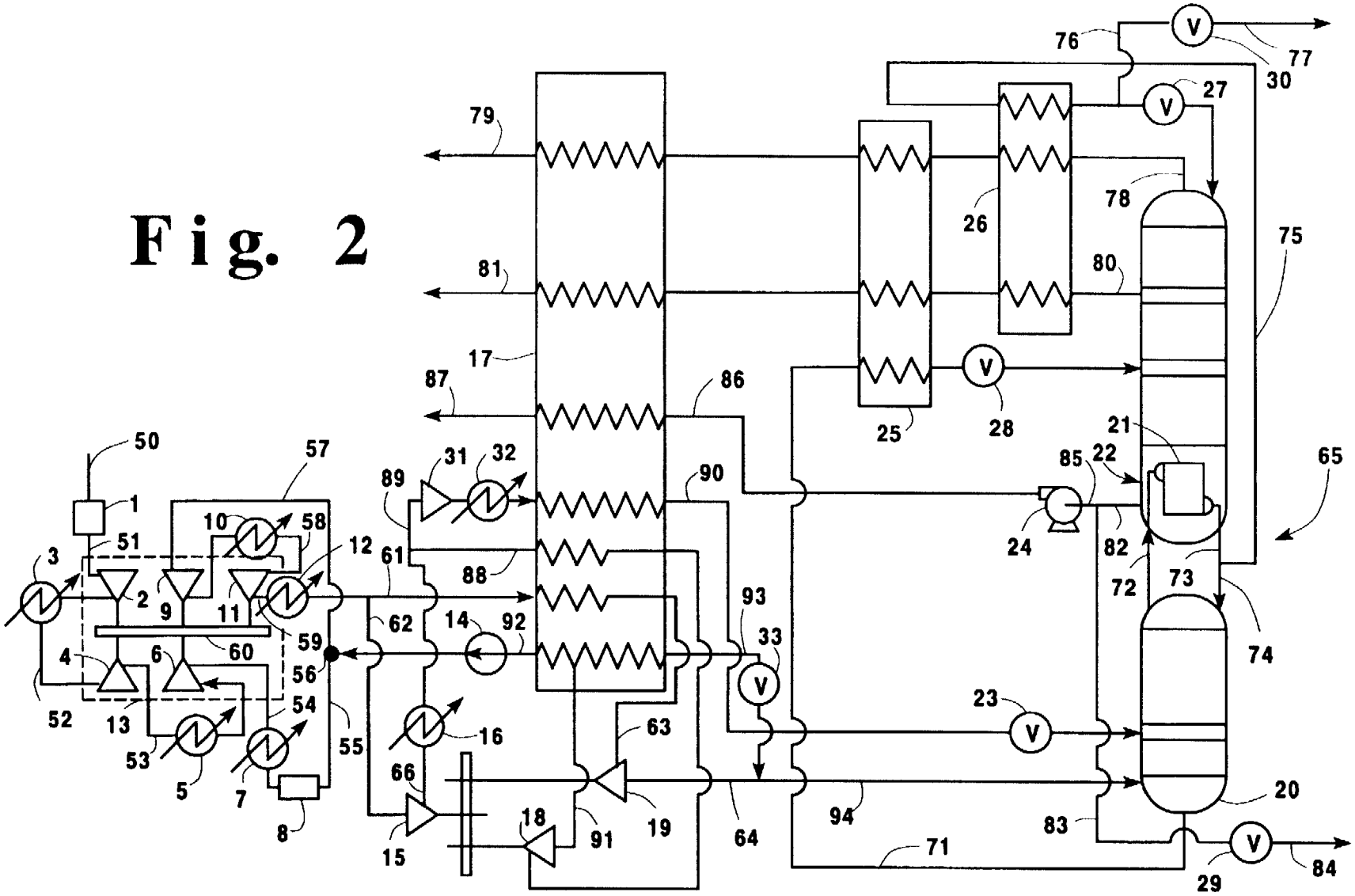
FIG. 2 is a schematic representation of another preferred embodiment of the invention.

FIG. 2 illustrates another embodiment of the invention. The elements of the embodiment illustrated in FIG. 2 which are common with those of the embodiment illustrated in FIG. 2 will not be discussed again in detail.

Referring now to FIG. 2 further compressed second part 66, after passage through cooler 16 is divided into stream 88 and stream 89. Stream 89 is compressed further by passage through compressor 31, cooled of heat of compression by passage through cooler 32, and passed through main heat exchanger 17 wherein it is liquefied. Resulting liquid feed air 90 is passed through valve 23 and into higher pressure column 20. Instead of passage through valve 23, feed air 90 may be passed through a dense phase turbo machine to recover the pressure energy and typically the recovered shaft work will drive an electrical generator. Stream 88 of second part 66 is cooled by passage through main heat exchanger 17 and turboexpanded by passage through secondary turboexpander 18. Resulting turboexpanded stream 91 is bifurcated into stream 92, which passes through pressure control device 14 and is recycled to the primary air compressor, and into stream 93 which is cooled in main heat exchanger 17, passed through valve 33, and combined with primary turboexpander discharge stream 64 to form stream 94 which is passed into higher pressure column 20 of cryogenic air separation plant 65. The embodiment of the invention illustrated in FIG. 2 is particularly advantageous when the discharge of booster compressor 15 is insufficient to warm the vaporizing oxygen stream 86. The bifurcation of warm turboexpansion stream 91 into streams 92 and 93 is advantageously employed in situations where the flow of recycle stream 92 is in excess of that required to deliver the desired flows of liquid product. By increasing the flow of stream 93, termed the recycle bypass stream, the power consumption of the process can be reduced, enabling more efficient liquid product production.

Now with the practice of this invention wherein at least a portion of the warm turbine discharge is recycled to the primary air compressor at an interstage position, one can efficiently carry out cryogenic air separation with the use of multiple turboexpanders. Although the invention has been described in detail with reference to certain preferred embodiments, those skilled in the art will recognize that there are other embodiments of the invention within the spirit and the scope of the claims. For example, the cryogenic air separation plant may comprise a single column, or may comprise three or more columns, such as where the cryogenic air separation plant comprises a double column with an argon sidarm column. Booster compressors 15 and 31 may be powered by an external motor or by the shaft work of expansion derived from turboexpanders 18 and 19.

What is claimed is:

1. A method for carrying out cryogenic air separation comprising:

(A) compressing feed air in a primary air compressor having a plurality of first through $n^{th}$ compression stages to produce compressed feed air;

(B) cooling a first part of the compressed feed air, turboexpanding the cooled first part, and passing the turboexpanded first part into a cryogenic air separation plant;

(C) further compressing a second part of the compressed feed air, cooling the further compressed second part, turboexpanding at least a portion of the cooled second part, and recycling at least some of the turboexpanded second part to the feed air between the first and the $n^{th}$ compression stage;

(D) producing liquid oxygen within the cryogenic air separation plant, withdrawing liquid oxygen from the cryogenic air separation plant, and vaporizing the withdrawn liquid oxygen by indirect heat exchange with both the cooling first part of the feed air and the cooling second part of the feed air to produce gaseous oxygen; and (E) recovering gaseous oxygen as product.

2. The method of claim 1 wherein a portion of the turboexpanded second part is combined with the turboexpanded first part and passed into the cryogenic air separation plant.

3. The method of claim 1 further comprising recovering liquid oxygen from the cryogenic air separation plant.

4. The method of claim 1 further comprising producing liquid nitrogen within the cryogenic air separation plant and recovering liquid nitrogen from the cryogenic air separation plant.

5. Apparatus for carrying out cryogenic air separation comprising:

(A) a primary air compressor having a plurality of first through $n^{th}$ compression stages, a main heat exchanger, a primary turboexpander, and a cryogenic air separation plant;

(B) means for passing feed air into the first stage of the primary air compressor and means for withdrawing feed air from the $n^{th}$ stage of the primary air compressor;

(C) means for passing feed air from the $n^{th}$ stage of the primary air compressor to the main heat exchanger, from the main heat exchanger to the primary turboexpander, and from the primary turboexpander to the cryogenic air separation plant;

(D) a booster compressor, a secondary turboexpander, means for passing feed air from the $n^{th}$ stage of the primary air compressor to the booster compressor, from the booster compressor to the main heat exchanger, from the main heat exchanger to the secondary turboexpander, and from the secondary turboexpander to the primary air compressor between the first and $n^{th}$ compression stage; and (E) means for passing liquid from the cryogenic air separation plant to the main heat exchanger and means for recovering vapor from the main heat exchanger.

6. The apparatus of claim 5 wherein the primary air compressor has at least 3 compression stages.

7. The apparatus of claim 5 wherein the means for passing liquid from the cryogenic air separation plant to the main heat exchanger comprises a liquid pump.

8. The apparatus of claim 5 wherein the cryogenic air separation plant comprises a double column comprising a higher pressure column and a lower pressure column.

9. The apparatus of claim 8 wherein the means for passing feed air from the primary turboexpander to the cryogenic air separation plant communicates with the higher pressure column.

10. The apparatus of claim 5 further comprising means for passing feed air from the secondary turboexpander into the cryogenic air separation plant.

* * * * *